US010196190B2

(12) United States Patent
Miller

(10) Patent No.: US 10,196,190 B2
(45) Date of Patent: Feb. 5, 2019

(54) DOMED CUP LID FOR HOLDING AN INVERTED CAN OR BOTTLE

(71) Applicant: Alexander K. Miller, Dallas, TX (US)

(72) Inventor: Alexander K. Miller, Dallas, TX (US)

( * ) Notice: Subject to any disclaimer, the term of this patent is extended or adjusted under 35 U.S.C. 154(b) by 1004 days.

(21) Appl. No.: 13/951,220

(22) Filed: Jul. 25, 2013

(65) Prior Publication Data

US 2013/0305515 A1 Nov. 21, 2013

Related U.S. Application Data

(63) Continuation-in-part of application No. 13/365,988, filed on Feb. 3, 2012.

(51) Int. Cl.

| | |
|---|---|
| ***B65D 77/28*** | (2006.01) |
| ***B65D 1/04*** | (2006.01) |
| ***B65D 51/24*** | (2006.01) |
| ***A47G 19/22*** | (2006.01) |
| ***A47G 23/02*** | (2006.01) |

(52) U.S. Cl.

CPC ..... *B65D 51/24* (2013.01); *A47G 19/2272* (2013.01); *A47G 23/0241* (2013.01); *Y10T 29/49826* (2015.01)

(58) Field of Classification Search

CPC ..... A24F 19/06; B65D 81/32
USPC ..... 220/501, 367.1
See application file for complete search history.

(56) References Cited

U.S. PATENT DOCUMENTS 5,497,892 A * 3/1996 Takatsuki ..... A47J 31/50 215/307

* cited by examiner

*Primary Examiner* — Andrew T Kirsch
*Assistant Examiner* — Kevin Castillo
(74) *Attorney, Agent, or Firm* — Frost Brown Todd LLC

(57) ABSTRACT

A lid for a cup is described where the lid acts to hold a can upside down inside the cup. The lid including a rim attachment mechanism allowing the lid to be attached to the cup and a dome connected to the rim attachment mechanism and having an aperture therein. The lid also includes a can receptacle extending from the top into the interior of the dome through the aperture in the dome, wherein the can receptacle is formed to accept a can and to hold the can in a fixed position relative to the lid, and a bottle receptacle extending from a bottom of the can receptacle, wherein the bottle receptacle is formed to accept a neck of the bottle and to hold the bottle in a fixed position relative to the lid.

7 Claims, 6 Drawing Sheets

DOMED CUP LID FOR HOLDING AN INVERTED CAN OR BOTTLE

CROSS REFERENCE TO RELATED INFORMATION

This application is a continuation-in-part application of U.S. patent application Ser. No. 13/365,988, filed Feb. 3, 2012.

TECHNICAL FIELD

The present disclosure is directed to lids for holding a can or a bottle inverted in a disposable cup.

BACKGROUND OF THE INVENTION

While beer and margaritas have always been popular drinks, a recent phenomenon has occurred where frozen margaritas have been combined with beer. The "beer rita" is typically made by inverting a bottle of beer into a glass or pitcher of frozen margaritas. This allows the beer to slowly combine with the margarita as it is being consumed. The popularity of the beer rita has been increasing as it has been shown on various reality televisions shows. While simply inverting a beer bottle into a drink glass is effective, it is not always stable and the beer bottle can fall or be easily knocked out of the glass. Further, the technique has only been used with traditional, wide rimmed, glass margarita glasses. It would be helpful to have an inexpensive disposable cup and lid that would hold a beer bottle securely in the disposable cup.

BRIEF SUMMARY OF THE INVENTION

An embodiment of a lid for a cup is described where the lid acts to hold a can upside down inside the cup. The lid including a rim attachment mechanism allowing the lid to be attached to the cup and a dome connected to the rim attachment mechanism and having an aperture therein. The lid also includes a can receptacle extending from the top into the interior of the dome through the aperture in the dome, wherein the can receptacle is formed to accept a can and to hold the can in a fixed position relative to the lid, and a bottle receptacle extending from a bottom of the can receptacle, wherein the bottle receptacle is formed to accept a neck of the bottle and to hold the bottle in a fixed position relative to the lid.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
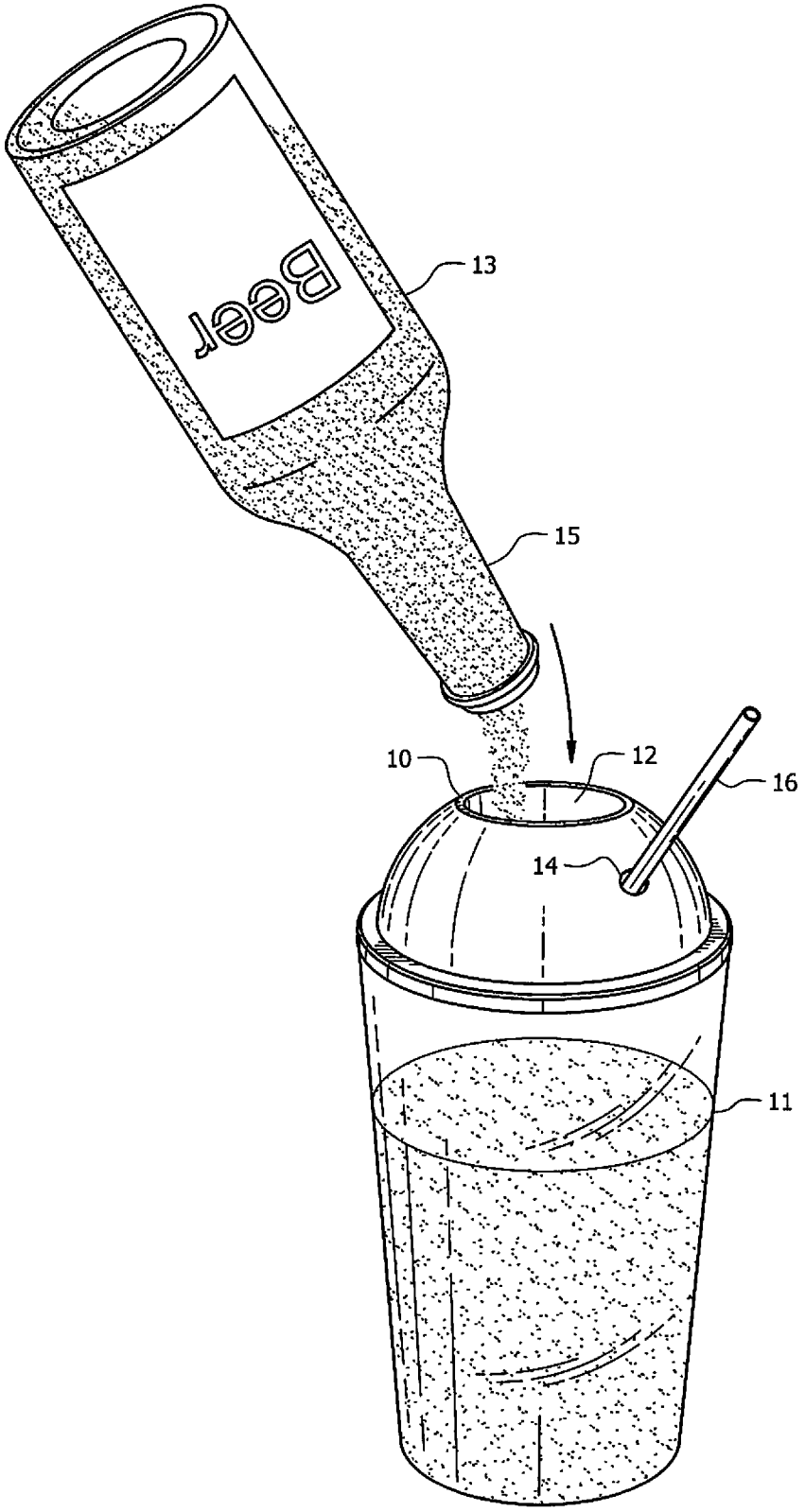
FIG. 1 is a perspective view of an embodiment of a cup lid according to the concepts described herein for holding a bottle inverted in a drinking glass.

Referring now to FIG. 1, an embodiment of a lid according to the concepts described herein is shown. As described above, it has become popular to invert a bottle of beer into a frozen mixed drink to form a new type of cocktail. Most commonly a bottle of beer is inserted upside down into a frozen margarita to create a "beer rita." While this is the most popular example of such a drink, any types of beverages could be used, alcoholic or non-alcoholic. Typically, the bottle is set into the glass or pitcher and rests against the edge of the glass or pitcher. Unfortunately, a bottle in that position can be prone to falling or being knocked out of the glass or pitcher. Additionally, that type of arrangement uses wide rimmed margarita glasses and does not work well for disposable cups. The present invention describes a lid for a disposable cup that can be used to hold a bottle inverted in the cup in a stable manner.

Lid 10 is an embodiment of a device to hold an inverted bottle in a cup 11 according to the concepts described herein. Lid 10 is positioned on cup 11 by snapping it onto the rim of the cup 11 as is common with lids for disposable cups, such that it is held securely to the cup 11. A bottle 13 can then be inserted upside down into an aperture 12 sized to receive the neck 15 of the bottle in lid 10 such that the bottle 13 is held inverted in the cup. In addition to the aperture 12, lid 10 preferably includes a straw hold 14 for receiving a typical drinking straw 16.

Figure 2:
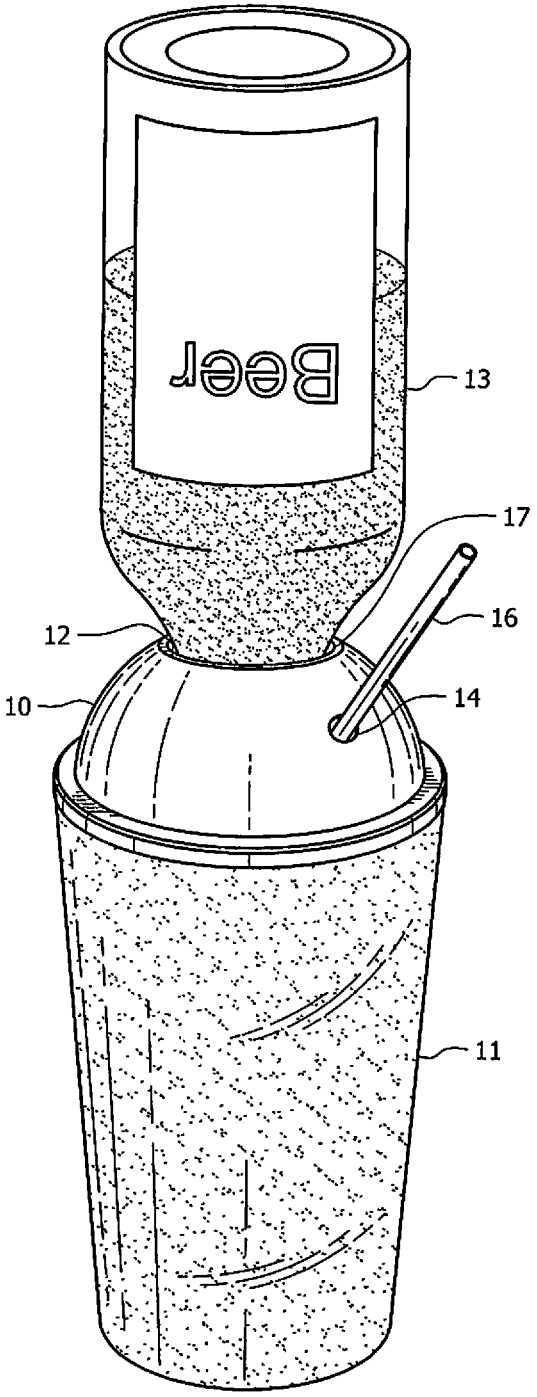
FIG. 2 is a perspective view of an embodiment of a cup lid according to the concepts described herein holding an inverted bottle in a cup.

FIG. 2 shows lid 10 on cup 11 with the bottle 13 inserted completely into aperture 12. In this fully inserted position, the shoulder of bottle 13 rests on an upper edge 17 of aperture 12. Upper edge 17 prevents bottle 13 from dropping further into cup 11 and provides a stable position for bottle 13 in lid 10.

Figure 3:
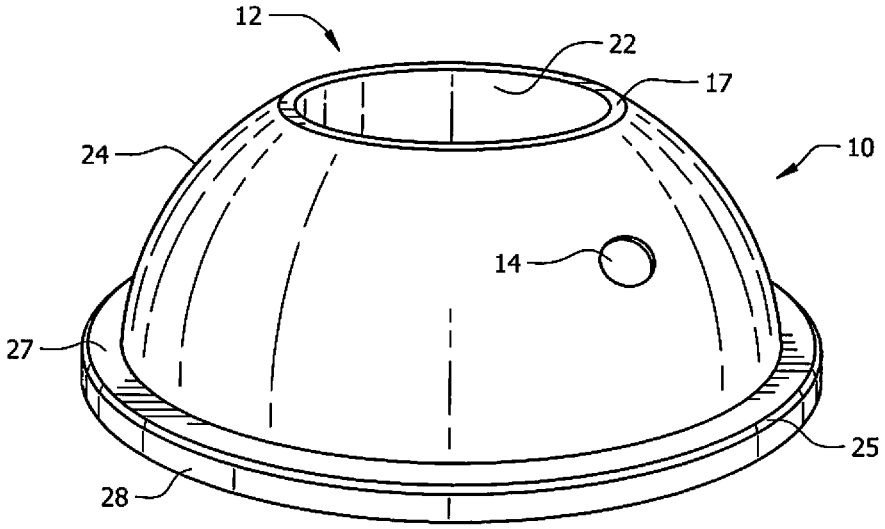
FIG. 3 is a perspective view of the top of an embodiment of a cup lid according to the concepts described herein.
Figure 4:
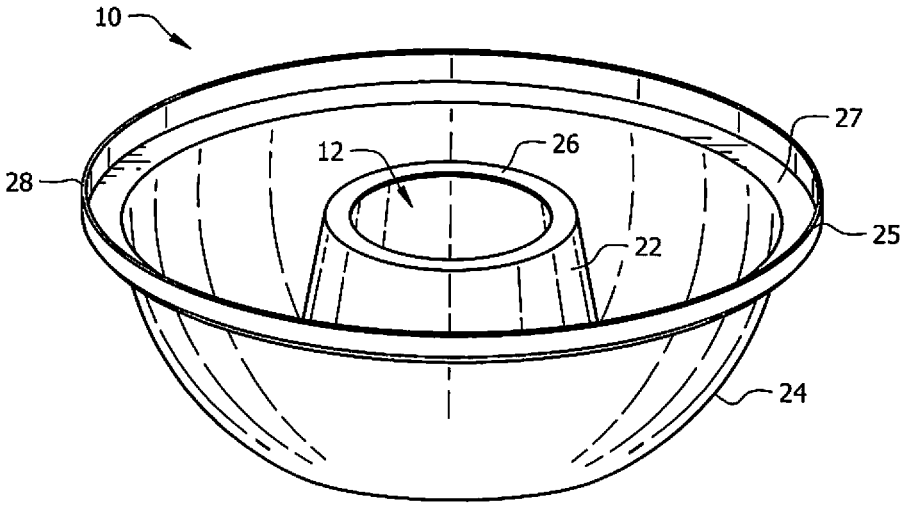
FIG. 4 is a perspective view of the bottom of an embodiment of a cup lid according to the concepts described herein.

Referring now to FIGS. 3 and 4, a preferred embodiment of lid 10 is described in more detail. Lid 10 is formed by dome 24, bottle receptacle 22, and rim attachment 25. Aperture 12, extends through the inner volume of bottle receptacle 22. Bottle receptacle 22 is preferably conical in shape such that it narrows as it extends into the interior of dome 24, and is sized to receive neck of a typical beer or soda bottle. Upper edge 17 of bottle receptacle 22 is smaller than the main diameter of the bottle such that the neck of the bottle will extend through aperture 12 but the remainder of the bottle will be held in place by the top surface 17 where bottle receptacle 22 extends from dome 24 as the shoulders of the bottle, where the bottle transitions from the neck to the main portion, rest against the top surface 17. Rim attachment 25 is formed by ledge 27 which contacts the rim of the cup and band 28 which snaps over the rim of the cup and holds lid 10 onto the cup as is well known. Straw hole 14 is provided in dome 24 to allow a straw to be inserted into the cup for drinking the liquid therein.

In FIG. 4, the bottle receptacle can be seen in more detail. As stated, the bottle receptacle is preferably conically shaped and includes a bottom ledge 26 adjacent to the aperture 12 in which the bottle is inserted. If the shoulder of the bottle inserted into lid 10 is too small to rest on upper edge 17, the bottle will be caught and held in place either by the conical shape of bottle receptacle 22 as it narrows or by ledge 26 which will act to catch the shoulder of the bottle.

Figure 5:
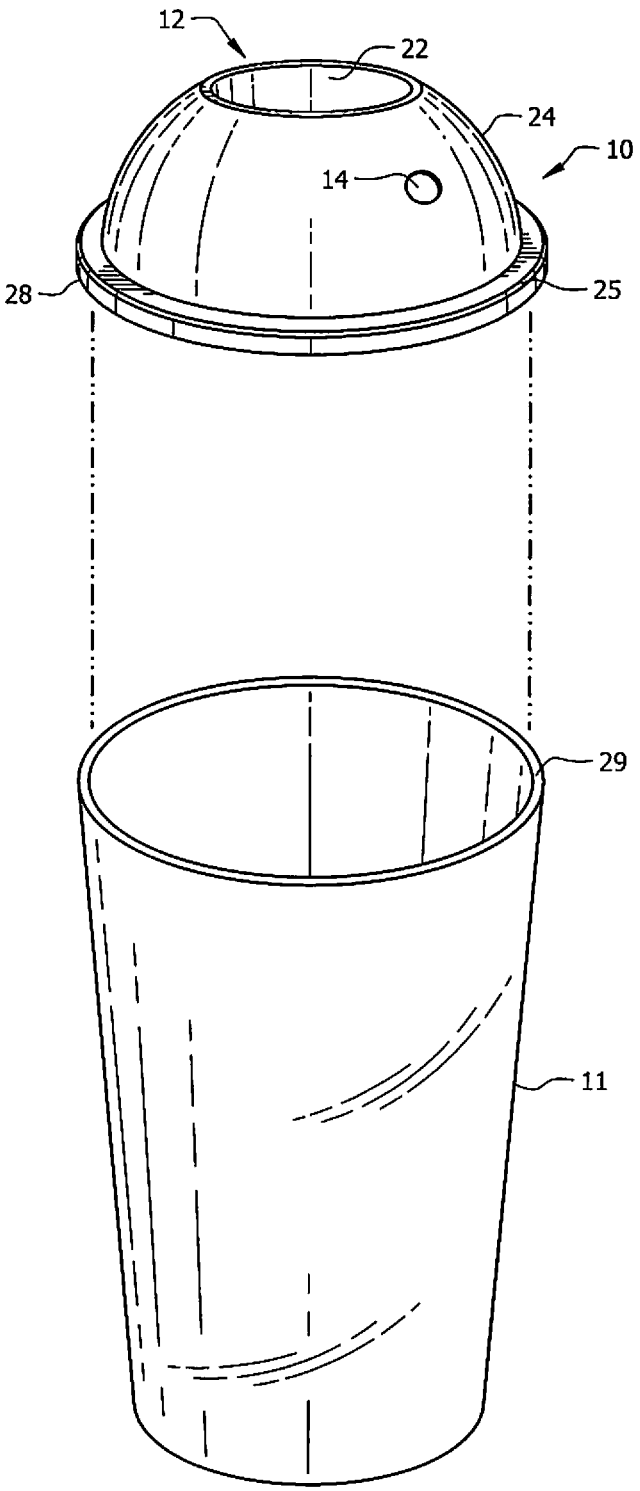
FIG. 5 is a perspective view of an embodiment of the cup lid shown in FIG. 4 showing its intended placement on a cup.

Referring now to FIG. 5, the embodiment of lid 10 shown in FIGS. 3 and 4 is shown relative to a cup. Cup 11 is sized to receive lid 10 by having the same diameter rim 29 as rim attachment 25. As lid 10 is inserted onto cup 11, band 28 fits over rim 29 and snaps in place to hold lid 10 to cup 11 as is well known with disposable lids and cups. Dome 24 extends above cup 11 and includes bottle receptacle 22 with aperture 12 for receiving an inverted bottle. Straw hole 14 allows for the insertion of a straw through lid 10 into cup 11.

Figure 6:
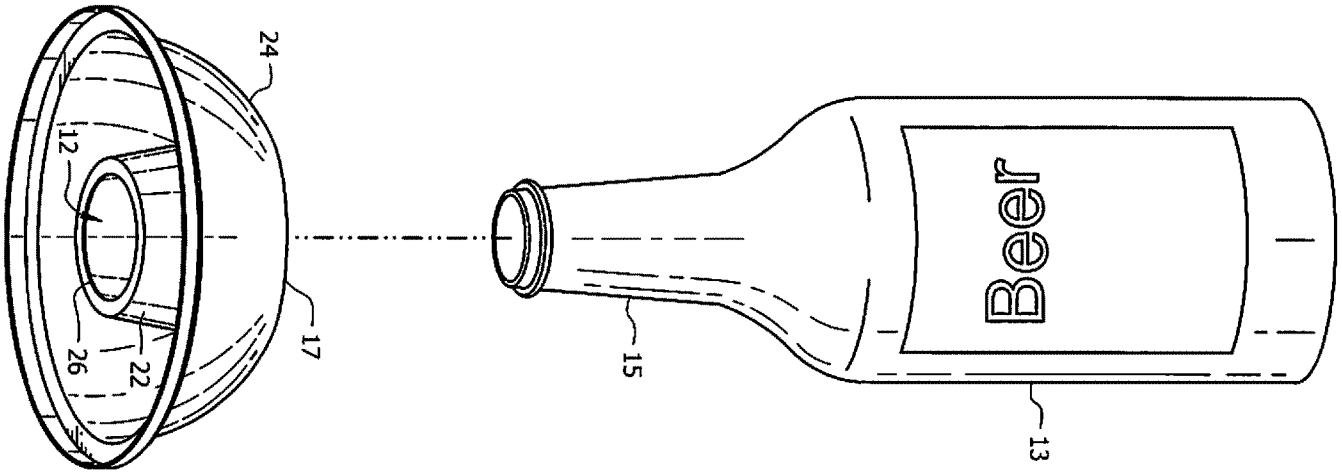
FIG. 6 is a perspective view of an embodiment of the cup lid shown before insertion of the inverted bottle.
Figure 7:
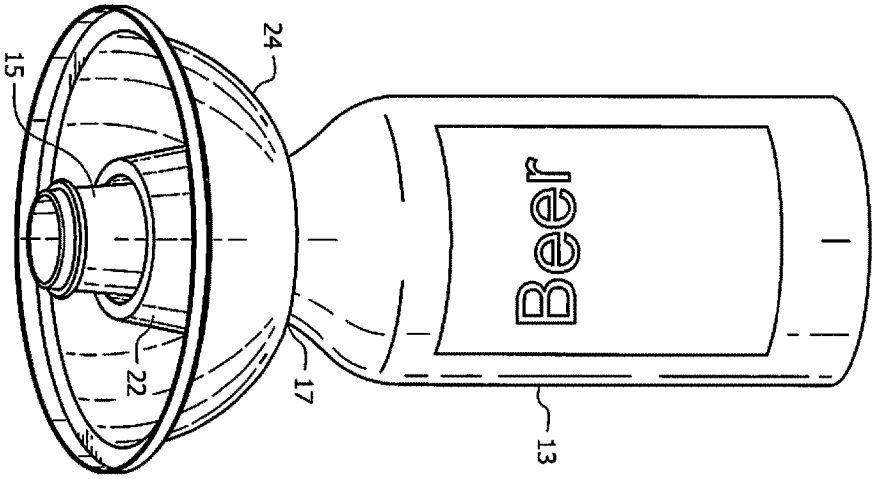
FIG. 7 is a perspective view of an embodiment of the cup lid shown in FIG. 6 after insertion of the inverted bottle.

Referring now to FIGS. 6 and 7, an embodiment of lid 10 is shown with a bottle before and after insertion, respectively. Bottle receptacle 22 of lid 10 is sized to receive neck 15 of bottle 13 as it is inserted into lid 10. Bottle 13 can come to rest on upper edge 17 of lid 10 or anywhere along the inner surface of bottle receptacle 22 or on ledge 26, such that bottle 13 is ultimately held in a fixed position with respect to lid 10. In the inserted position, the contents of bottle 13 are permitted to flow into the cup (not shown) and mix with the existing contents of the cup, such as a margarita.

As an additional feature in certain embodiments of lid 10, there is space on dome 24 for promotional or advertising material to be added to lid 10. Lid 10 can be formed from any suitable material, but is preferably a plastic having enough strength to support a full bottle inserted into aperture 12 while lid 10 is sitting on the rim of a cup.

Figure 8:
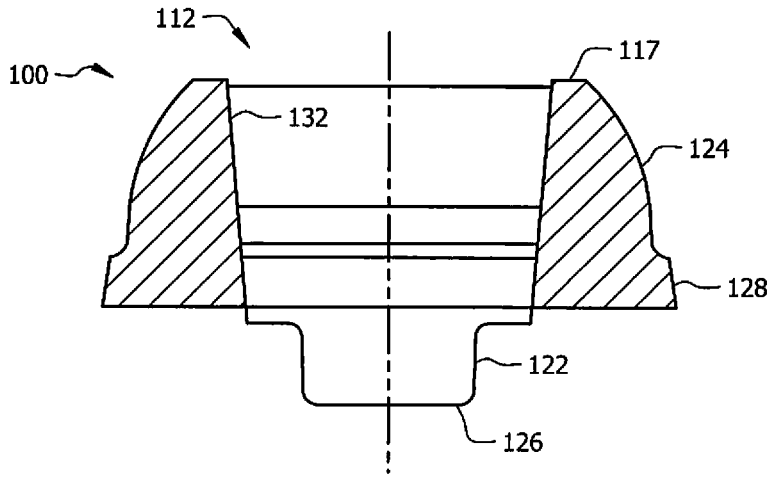
FIG. 8 is a sectional view of an embodiment of a cup lid capable of holding an inverted can as well as an inverted bottle according to the concepts described herein.
Figure 9:
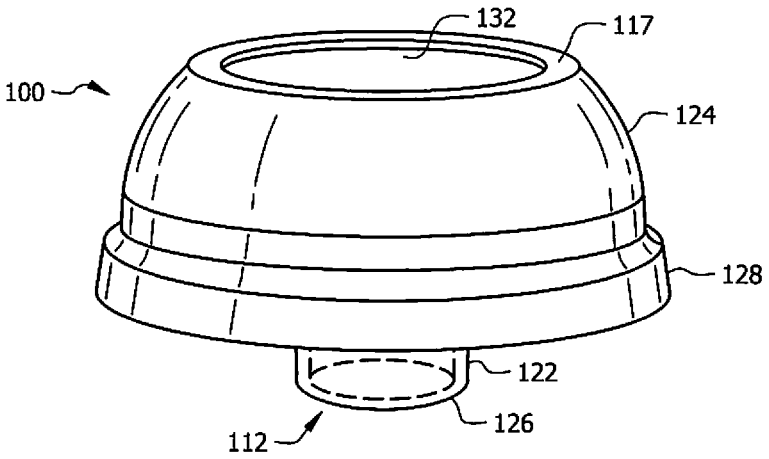
FIG. 9 is a perspective view of the cup lid shown in FIG. 8.

Referring now to FIGS. 8 and 9, a preferred embodiment of lid 100 capable of holding a can as well as a bottle is described in more detail. Lid 100 is formed by dome 124, can receptacle 132, bottle receptacle 122, and rim attachment 128. Aperture 112, extends through the inner volume of can receptacle 132 and bottle receptacle 122. Both can receptacle 132 and bottle receptacle 22 are preferably conical or tapering in shape such that it narrows as it extends into the interior of dome 24. Can receptacle 132 is sized to allow a can of similar diameter to a typical 12 ounce to be inserted therein and is deep enough to hold the can in place. Bottle receptacle is sized to receive neck of a typical beer or soda bottle. The upper edge of bottle receptacle 22, which is also the transition between can receptacle 132 and bottle receptacle 122, is smaller than the main diameter of the bottle such that the neck of the bottle will extend through aperture 112 but the remainder of the bottle will be held in place by the upper surface of bottle receptacle 122, as the shoulders of the bottle, where the bottle transitions from the neck to the main portion, rest against the transition between the can receptacle 132 and bottle receptacle 122. Rim attachment 128 is formed by a ledge which contacts the rim of the cup and band which snaps over the rim of the cup and holds lid 100 onto the cup as is described above. A straw hole can also be provided in dome 124 to allow a straw to be inserted into the cup for drinking the liquid therein.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A lid for holding a can or a bottle upside down inside a cup, the lid comprising:

a rim attachment mechanism allowing the lid to be attached to the cup;

a dome connected to the rim attachment mechanism such that the dome extends above the cup when the lid is attached to the cup, the dome having an aperture therein;

a can receptacle extending from the top of the dome into the interior of the dome through the aperture in the dome, wherein the can receptacle is formed to accept a can and to hold the can in a fixed position relative to the lid; and a bottle receptacle extending from a bottom of the can receptacle, wherein the bottle receptacle is formed to accept a neck of the bottle and to hold the bottle in a fixed position relative to the lid.

2. The lid of claim 1 wherein the can receptacle tapers as it extends from a top edge of the dome into the interior of the lid.

3. The lid of claim 1 wherein a transition between the can receptacle and the bottle receptacle includes a ledge at the bottom of the can receptacle such that the ledge engages shoulders of the bottle when inserted into the lid.

4. The lid of claim 1 wherein the dome includes a space for displaying promotional material.

5. The lid of claim 1 wherein the bottle is a beer bottle.

6. The lid of claim 1 wherein the can is a beer or soda can.

7. The lid of claim 1 wherein the lid is integrally formed from molded plastic.

* * * * *